United States Patent [19]

Yagino et al.

[11] Patent Number: 4,841,120

[45] Date of Patent: Jun. 20, 1989

[54] THERMAL HEAD

[75] Inventors: Masamori Yagino; Masato Taniguchi; Yoshitomo Ito; Toshimitsu Takano; Wataru Ishikawa; Sadatoshi Kikuchi; Tetsuo Endo, all of Miyagi, Japan

[73] Assignee: Sony Corporation, Tokyo, Japan

[21] Appl. No.: 95,269

[22] Filed: Sep. 11, 1987

[30] Foreign Application Priority Data

| | | | |
|---|---|---|---|
| Sep. 12, 1986 | [JP] | Japan | 61-214078 |
| Dec. 26, 1986 | [JP] | Japan | 61-316154 |
| Feb. 28, 1987 | [JP] | Japan | 62-29143[U] |

[51] Int. Cl.[4] ..... B41J 3/20

[52] U.S. Cl. ..... 219/216; 219/543; 346/76 PH

[58] Field of Search ..... 219/216 PH, 543; 346/76 PH; 400/120

[56] References Cited

U.S. PATENT DOCUMENTS

| | | | |
|---|---|---|---|
| 3,754,278 | 8/1973 | Borden | 219/216 PH |
| 4,110,598 | 8/1978 | Small | 219/216 PH |
| 4,605,936 | 8/1986 | Yamamoto | 346/76 PH |
| 4,651,168 | 3/1987 | Terajima | 219/216 PH |
| 4,680,593 | 7/1987 | Takeno | 219/216 PH |
| 4,701,593 | 10/1987 | Hiramatsu | 219/216 PH |

FOREIGN PATENT DOCUMENTS

| | | | |
|---|---|---|---|
| 59-73973 | 4/1984 | Japan | 219/216 PH |
| 60-9769 | 1/1985 | Japan | 219/216 PH |
| 60-19559 | 1/1985 | Japan | 219/216 PH |
| 61-62368 | 7/1986 | Japan | 219/216 PH |

*Primary Examiner*—Teresa J. Walberg

[57] ABSTRACT

A thermal head which is reduced in restriction in dimension of a substrate to allow reduction in size thereof and wherein the contacting characteristic of the substrate with a platen is improved to assure a high quality of printing. The thermal head has a heat generating resistor element and a driving circuit therefor both formed on a substrate, and a suppporting heat radiating member joined to one face of the substrate on which the resistor element is located. The substrate is ground at least at a portion of the opposite face thereof corresponding to a heat generating portion of the resistor element to make the thickness smaller than the other portion of the substrate. Thermal recording is effected by the ground portion of the substrate. The substrate may be made of a transparent or translucent inexpensive material such as quartz or glass. Various forms of supporting heat radiating plate to be incorporated in the thermal printers are also disclosed.

22 Claims, 8 Drawing Sheets

THERMAL HEAD

BACKGROUND OF THE INVENTION

1. Field of the Invention

This invention relates to a thermal head to be installed in a facsimile or a printer of various types, and more particularly to improvements in structure of a thermal head and in mounting structure for an integrated circuit device for driving a thermal head.

2. Prior Art

Conventionally, a thermal head of the line type or the serial type principally employs, as a driving system for heat generating resistor elements thereof, either a driving system of the direct driving type or that of the diode matrix type. In a thermal head employing either type of driving system, semiconductor element pellets such as ICs (integrated circuits) and diodes constituting a driving circuit device or the like are directly mounted on a thermal head substrate in order to allow miniaturization of the thermal head.

However, a thermal head of either type has many restrictions on reduction in size, reliability, price of products and so on, and improvement thereof is desired in these regards.

In particular, a conventional thermal head has a structure as shown in FIG. 17 wherein, in order to protect a semiconductor element 102 mounted on a substrate 101, the semiconductor element 102 is molded with encapsulating agent 103 and is further covered by an enclosure cover 104.

Further, in the thermal head of the type, it is necessary that the enclosure cover 104 can escape from a path of paper from the platen 105. In other words, the distance $W_1$ from a heat generating resistor element to the semiconductor element 102 is restricted by a thickness t of the cover 104 and a dimension of a contour of the platen 105, and accordingly there is a limitation in miniaturization of the head. Besides, this limitation makes an obstruction to minimization of the substrate 101, and since a glazed ceramics material ($Al_2O_3$) which is conventionally used in many cases as a material for substrates is expensive, it is desired for the head to be improved also from a point of view of a material cost.

Meanwhile, in the conventional thermal head, a structure is employed wherein a wear resisting layer is formed over the heat generating resistor element via an oxidation resisting layer in order to protect the heat generating resistor element from the platen 105.

However, since the oxidation resisting layer and the wear resisting layer are layered by a thin film forming technique such as sputtering, there is a restriction in assuring the life of the head against wear by employing a thick film for the wear resisting layer. If it is attempted to form a film, for example, of 10 microns thick for a wear resisting layer, much time is required for formation of the film, and cracks and some other defects may be caused by stress of the film upon formation of the film, resulting in reduction in reliability of the head.

Further, in order to assure the contacting characteristic of the head with the platen, the thickness of a film of electrodes by way of which the heat generating resistor element is fed is limited to 0.5 to 1.5 microns or so. Accordingly, a wire bonding operation is complicated, and there remains a problem in regard to the reliability of connection of the electrodes.

By the way, in the field of thermal recording, there is a tendency in recent years to reduce the size and improve the reliability of a thermal head, and such a conventional thermal head as described above cannot sufficiently meet those requests. Accordingly, it is desired for a thermal head to be improved in this regard.

SUMMARY OF THE INVENTION

It is an object of the present invention to provide a thermal head which is reduced in restriction in dimension of a substrate to allow reduction in size thereof and wherein the contacting characteristic of the substrate with a platen is improved to assure a high quality of printing.

It is another object of the present invention to provide a thermal head wherein positioning of a heat generating resistor element to be formed on a substrate relative to a supporting heat radiating member can be done with accuracy and a portion of the substrate at a recording face is formed with a predetermined thickness so that the contacting characteristic of the substrate with a platen is good to allow a high quality of printing to be obtained.

It is a further object of the present invention to provide a thermal head which allows simplification of a process of producing the same and improvement in available percentage and is good in heat resisting property and reliability.

In order to attain the object, according to one aspect of the present invention, there is provided a thermal head wherein a heat generating resistor element and driving circuit means are formed on a substrate and said heat generating resistor element is driven by said driving circuit means to generate heat in order to effect thermal recording, characterized in that a supporting heat radiating member is joined to one face of said substrate on which said heat generating resistor element is located, and said substrate is ground at least at a portion of a face thereof opposite to said one face corresponding to a heat generating portion of said heat generating resistor element such that the ground portion of said substrate has a smaller thickness than the remaining portion of said substrate, whereby thermal recording is effected by said ground portion of said substrate. Thus, with the improved thermal head, thermal recording is performed by the face of the substrate opposite to the face on which the heat generating resistor element and the driving circuit means are formed while, with a conventional thermal head, thermal recording is performed by a face of a substrate on which a heat generating resistor element and a driving circuit device are formed. Accordingly, the space in which the heat generating resistor element and the driving circuit means such as a semiconductor element or elements is to be located on the face different from the face of the substrate which is slidably contacted by a platen can be set freely without the necessity of considering a path of record paper from the platen. Consequently, the restriction in size of the substrate is moderated, and accordingly reduction in size of the thermal head can be realized readily. At the same time, since the opposite face of the substrate serves as a thermal recording face and has a flattened structure, the contacting characteristic of the substrate and accordingly of heat sensitive record paper with the platen is improved significantly, and accordingly a high quality of printing can be attained. Further, since the thickness of a wear resisting layer can be set freely by suitably adjusting the grinding working of the substrate due to the fact that the substrate acts as a conventional wear resisting layer, elongation of the life of the thermal head can be attained. In addition, since a conductor layer, an electrode and so on can have a thin film structure and accordingly wire bonding can be effected readily with high accuracy, the thermal head can be improved in reliability.

In a modified form, the substrate is formed from a transparent or translucent wear resisting material. According to the modification, the heat generating resistor element and some other members on the one face of the substrate can be observed and recognized from the side of the opposite face of the substrate. Accordingly, positioning of the heat generating resistor element and so on relative to the supporting heat radiating plate can be performed with accuracy, and the thickness of the substrate at a portion of the recording face with respect to the heat generating resistor element can be set with accuracy by suitably adjusting the grinding working. Consequently, improvement in quality of printing and in reliability of the head can be attained.

According to another aspect of the present invention, there is provided a thermal head, comprising a substrate, a heat generating resistor element located on said substrate, driving circuit means located on said substrate for driving said heat generating resistor element, wiring circuit means for interconnecting said heat generating resistor element and said driving circuit means, and a supporting heat radiating member having a through-hole formed to extend in the direction of the thickness therein and mounted on said substrate such that said driving circuit means may be accommodated in said through-hole. In producing the thermal head, it is possible to adhere the supporting heat radiating member to the substrate before adhesion of the driving circuit means and a flexible printed circuit plate which is provided to transmit an external signal to the driving circuit means. Consequently, the process of producing a thermal head can be changed, and for example, after adhesion of a supporting heat radiating member on a substrate, formation of driving circuit means on the substrate, pouring of encapsulating agent into the through-hole of the supporting heat radiating member, adhesion of a flexible printed circuit board, and some other steps may be performed. Accordingly, there is a high degree of freedom in selection of a bonding agent which is used for adhesion of the supporting heat radiating member to the substrate, and thermal deterioration at adhered portions can be prevented. Besides, since encapsulating agent may be poured into the through-holes of supporting heat radiating members mounted on a set substrate from which a plurality of substrates for thermal heads are to be produced, the controllability of the encapsulating agent can be improved and accordingly improvement in productivity and in available percentage can be attained.

According to a further aspect of the present invention, there is provided a thermal head, comprising a substrate, a heat generating resistor element located on said substrate, driving circuit means located on said substrate for driving said heat generating resistor element, a flexible base plate located on said substrate for transmitting an external signal to said driving circuit means, wiring circuit means for electrically interconnecting said heat generating resistor element, said driving circuit means and said flexible base plate, and a wiring circuit having an external lead circuit and formed on one of opposite faces of said flexible base plate on which said driving circuit means is mounted, said flexible base plate being connected at the other face thereof in a closely contacting relationship to said substrate. With the improved thermal head, the space required for connection of the flexible base plate serves also as a space for mounting of the driving circuit means, and accordingly such a space for connection that has been conventionally required is omitted. Further, since the wiring circuit is formed on the flexible base plate and the driving circuit means is mounted on the flexible base plate, a gold wire for the driving circuit means can be directly connected to the wiring circuit for transmission of an external signal, and accordingly a route for signal transmission can be simplified.

The above and other objects, features and advantages of the present invention will become apparent from the following description and the appended claims, taken in conjunction with the accompanying drawings.

DETAILED DESCRIPTION OF THE PREFERRED EMBODIMENTS

Embodiment 1

Figure 1:
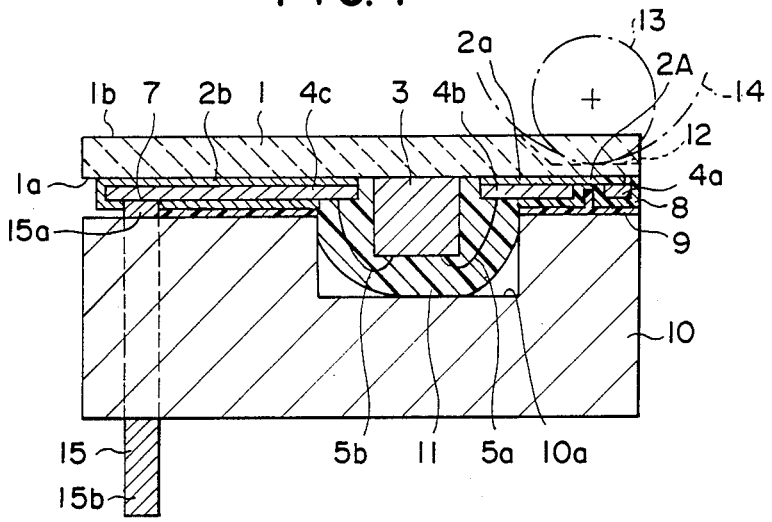
FIG. 1 is a schematic sectional view of a thermal head to which the present invention is applied.

Referring first to FIG. 1, a thermal head according to a first embodiment of the present invention is shown. The thermal head shown includes heat generating resistor elements or patterns 2*a*, 2*b* and a driving circuit device or semiconductor element 3 such as an integrated circuit all formed on one flat face 1*a* of a substrate 1. A supporting heat radiating plate 10 is integrally joined to the heat generating resistor elements 2*a*, 2*b* and the semiconductor element 3 via an oxidation resisting layer 8 and an adhesive layer 9. On the other hand, a rear face 1*b* of the substrate 1 serves as a thermal recording face, and a groove 12 for slidably contacting with a platen 13 is formed in the rear face 1*b* of the substrate 1. Thus, when thermal recording on heat sensitive record paper 14 is to be effected, the platen 13 is pressed against and held in the groove 12 of the rear face 1*b* of the substrate 1 with the heat sensitive record paper 14 interposed therebetween.

The heat generating resistor elements 2*a*, 2*b* and the semiconductor element 3 are electrically communicated with each other by way of conductor layers or electrode patterns 4*a*, 4*b*, 4*c* and connecting wires 5*a*, 5*b* of gold or some other suitable material which are connected to the conductor layers 4*b*, 4*c* and the semiconductor element 3 by a suitable technique such as wire bonding. Thus, a heat generating resistor portion 2A of the heat generating resistor element 2*a* adjacent a location at which the conductor layers 4*a*, 4*b* formed in layers on the heat generating resistor element 2*a* are separated from each other generates heat and hence contributes to thermal recording. On the other hand, an electrode 7 for establishing electric communication with an external driver circuit is located at an end portion of the conductor layer 4*c* on the other heat generating resistor element 2*b* and is connected to a connecting pin 15. Further, the oxidation resisting layer 8 is formed over the heat generating resistor elements 2*a*, 2*b* and the semiconductor element 3, and the supporting heat radiating plate 10 is integrally joined to the oxidation resisting layer 8 via the adhesive layer 9.

Accordingly, in the thermal head of the present embodiment, the semiconductor element 3 is driven by a driving current supplied via the connecting pin 15 to selectively cause the heat generating resistor portion 2A to generate heat to effect thermal recording by the rear face 1*b* side of the substrate 1.

Since the rear face 1*b* of the substrate in the thermal head of the present embodiment serves as a recording face in this manner, the contacting characteristic thereof with the platen 13 is good. Further, since the face 1*a* on which the heat generating resistor elements 2*a*, 2*b* and the semiconductor element 3 are formed is different from the recording face 1*b*, a space in which the semiconductor element 3 and so on are to be located can be set freely without the necessity of considering a path of paper from the platen 13. Accordingly, the restriction in dimension of the substrate 1 can be moderated significantly so that reduction in size of the substrate can also be attained.

Here in the present embodiment, the substrate 1 serves as a wear resisting layer for preventing possible wear of the heat generating resistor elements by sliding contact thereof with the platen 13. Since the thickness of the substrate 1 can be set freely by adjusting the degree of grinding of the substrate, it can be increased to 10 to 20 microns readily. Accordingly, the wear resisting property is improved, which will result in elongation of the life of the head. Meanwhile, as a material of the substrate 1, it is not limited to an expensive material such as a glazed ceramics material as in a conventional technique, and an inexpensive material such as glass or quartz may be used. Accordingly, a significant reduction in material cost can be attained coupled with such reduction in size of the substrate 1 as described above. In addition, a thin plate such as a silicon wafer can also be used for the substrate 1. Meanwhile, since the heat generating resistor pattern 2*a* is formed on the front face 1*a* of the substrate 1, that is, on a face opposite to the face which is to contact with heat sensitive record paper, there is no necessity of forming a thick wear resisting layer on the heat generating resistor patterns as in a conventional technique. Accordingly, a step of forming a wear resisting layer by sputtering which is low in producing working efficiency becomes unnecessary, which results in improvement in productivity. Where the heat generating resistor patterns 2*a*, the electrode patterns 4*a*, 4*b* and so on are to be formed from a thick film, they can be produced without an expensive equipment such as a sputtering device.

Meanwhile, the heat generating resistors 2*a*, 2*b* are formed separately from each other on the one flat face 1*a* of the substrate 1, and the semiconductor element 3 is mounted directly at a portion of the one flat face 1*a* of the substrate 1 in such a separating spacing between the heat generating resistors 2*a*, 2*b*.

Here, the conductive layers 4*a*, 4*b* made of a conductive metal material such as copper or gold are located on the heat generating resistor element 2*a*, and the heat generating resistor portion 2A adjacent a separating spacing between the conductor layers 4*a* and 4*b* generates heat and thus contributes to thermal recording. Meanwhile, the conductor layer 4*c* is formed on the other heat generating resistor element 2*b*, and part of the conductor layer 4*c* constitutes the electrode 7 for establishing electric communication with an external driver circuit. The electrode 7 is connected to an end 15*a* of the connecting pin 15 which extends through and outwardly from the supporting heat radiating plate 10 so that the other end 15*b* thereof may be connected to an external cable. It is to be noted that the heat generating resistor element 2*b* which does not directly contribute to thermal recording may be formed if and where necessary and may be omitted in some cases.

The semiconductor element 3 and the conductor layers 4*b*, 4*c* are connected to each other by the conductors 5*a*, 5*b*, respectively, using a wire bonding technique and are enclosed in an encapsulating agent 11. Since here in the present embodiment only the rear face 1*b* of the substrate 1 serves as a recording face, the thickness and shape of the conductor layers 4b, 4c can be set freely. Accordingly, there is no need of patterning with a thin conductor layer of a large area as in a conventional technique, and thus where the conductor layers 4b, 4c have a structure of a thick film of a small area, such a wire bonding operation as described above can be performed readily and assuredly. Consequently, a thermal head of a reduced size and improved reliability can be provided.

Further, the oxidation resisting layer 8 of $Si_3N_4$, $SiO_2$ or a like substance is formed on the heat generating resistor elements 2a, 2b and the semiconductor element 3, and the supporting heat radiating plate 10 is integrated with the heat generating resistor elements 2a, 2b and the semiconductor element 3 via the insulating adhesive layer 9.

The supporting heat radiating plate 10 has a channel-shaped recess 10a formed at a portion thereof opposing to the semiconductor element 3. Thus, the semiconductor element 3 and the conductors 5a, 5b are located in the recess 10a of the supporting heat radiating plate 10 and are further enclosed in the encapsulating agent 11. Accordingly, the various members including the semiconductor element 3 are protected by the supporting heat radiating plate 10.

In this manner, in the thermal head of the present embodiment, the supporting heat radiating plate 10 has a heat radiating function and another function as a container package for protecting the semiconductor element 3. Accordingly, there is an advantage that simplification in production steps and reduction in number of parts can be attained.

Here, the supporting heat radiating plate 10 may be made of a suitable one of materials including ceramics such as $Al_2O_3$, metal alloys of the Fe-Ni family, metal materials such as iron and aluminum which are good in heat conductivity, and so on. It is to be noted that where a material having a low electric resistance is used for the supporting heat radiating plate 10, it is a matter of course that the connecting pin 15 and the supporting heat radiating plate 10 are isolated from each other.

Further, the adhesive layer 9 interposed between the heat generating resistor element 2a and the supporting heat radiating plate 10 has, in addition to an adhering function, a function as a glazed layer as in a conventional technique, and accordingly a material having a suitable heat conductivity is used for the adhesive layer 9. For example, glass materials of a low melting point, epoxy resin materials, polyimide resin materials and so on may be suitable.

Accordingly, in the thermal head of the present embodiment, thermal designing can be effected readily by suitably setting the adhesive layer 9 and the supporting heat radiating plate 10 in thickness and material.

Besides, since the oxidation resisting layer 8 must be selected only considering the compatibility thereof in close contactness, coefficient of thermal expansion and so on with the heat generating resistor element 2a due to the fact that the heat generating resistor element 2a is interposed between the substrate 1 serving as a wear resisting layer and the oxidation resisting layer 8, the degree of freedom in selection of the oxidation resisting layer 8 is high.

Since according to the present embodiment reduction in size of the substrate 1 and accordingly reduction in area of a contacting face of the platen are allowed in this manner, a thermal head of the so-called vertical type is also made possible. Accordingly, color printers or like devices of the 1-platen multi-head type of a small size can be produced at a low cost.

While the preferred embodiment of the present invention shown in FIG. 1 has been described above, it is a matter of course that the present invention is not limited to the specific embodiment and can assume various structures without departing from the spirit and scope of the present invention. Thus, while other examples are described below, like parts are denoted by like reference numerals to those of the thermal head shown in FIG. 1, and detailed description thereof is omitted herein.

EMBODIMENT 2

Figure 2:
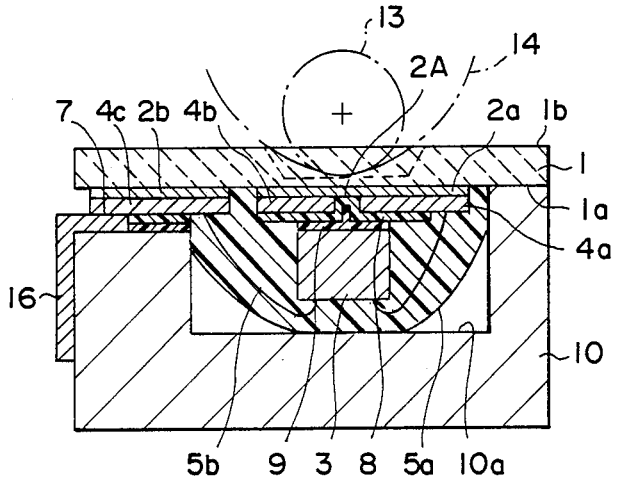
FIG. 2 is a similar view but illustrating a second embodiment of the present invention wherein a driving circuit device is located on a heat generating resistor element.

Referring now to FIG. 2, a thermal head is shown which can be further reduced in size by locating a semiconductor element above a heat generating element via an oxidation resisting layer and an adhesive layer. In particular, the thermal head shown includes heat generating resistor elements or patterns 2a, 2b and conductor layers or electrode patterns 4a, 4b, 4c all formed on one flat face 1a of a substrate 1, and a semiconductor element 3 is formed via an oxidation resisting layer 8 on a heat generating resistor portion 2A which contributes to thermal recording. The semiconductor element 3 is accommodated in a recess 10a formed in a supporting heat radiating plate 10. Further, in the present embodiment, a lead conductor 16 for establishing electric communication with an external electrode is provided on a side face of the supporting heat radiating plate 10 via an electrode 7. However, the lead conductor 16 may otherwise be constituted from a connecting pin similarly as in the preceding embodiment.

While in the embodiments shown in FIGS. 1 and 2 the groove 12 for slidably contacting with the platen 13 is formed in the rear face 1b of the substrate 1, the contacting characteristic thereof with the platen 13 can be further improved if an improved manner in which the substrate 1 serving as a wear resisting layer is ground is devised. Such embodiments are illustrated in FIGS. 3 and 4.

EMBODIMENT 3

Figure 3:
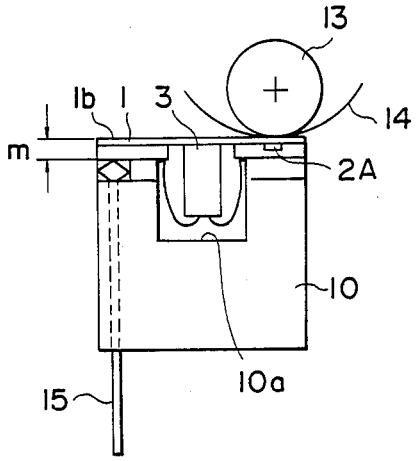
FIG. 3 is a schematic illustration of a thermal head illustrating a third embodiment of the present invention wherein an entire substrate is ground thinly.
Figure 4:
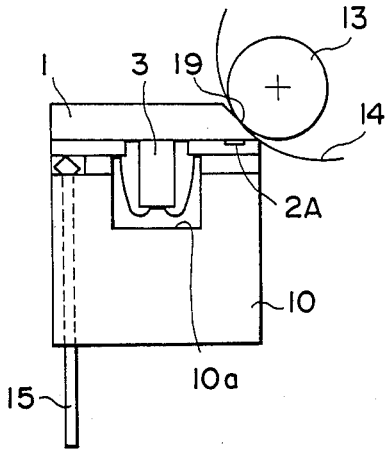
FIG. 4 is a similar view but illustrating a fourth embodiment of the present invention wherein a face of a substrate is ground obliquely.

Referring to FIG. 3, a thermal head shown includes a substrate 1 which is surface ground over an entire rear face 1b thereof until it has a predetermined thickness m in order to assure the contacting characteristic thereof with a platen 13 and to attain improvement in quality of printing. Here, if the thickness m of the substrate 1 is too great, it is not preferable in that the conductivity of heat generated by a heat generating resistor body 2A is low, which will result in low quality of printing. On the contrary, if the thickness m of the substrate is set thin, it is not preferable in that the working therefor will be difficult accordingly and the substrate will not exhibit a satisfactory function as a wear resisting layer. Thus, the thickness l is preferably a value of $1\ \mu m \leqq L \leqq 20\ \mu m$ or so but may be set suitably taking a material of the substrate 1 and so on into consideration.

EMBODIMENT 4

In the meantime, a thermal head shown in FIG. 4 is constituted such that an end portion of a substrate 1 serving as a wear resisting layer adjacent a heat generating resistor element 2 is cut obliquely to form an inclined face 19 against which a platen 13 is pressed via heat sensitive record paper 14 to effect thermal recording on the heat record paper 14. By forming the inclined face 19 as a recording face in this manner, the close contacting characteristic thereof with the platen 13 is improved to obtain a good quality of printing.

EMBODIMENT 5

Figure 5:
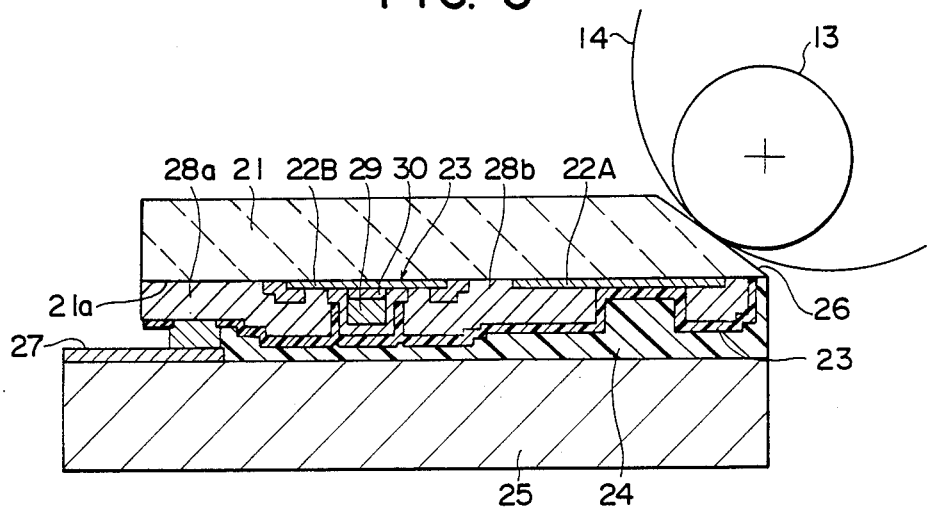
FIG. 5 is a schematic sectional view of a thermal head illustrating a fifth embodiment of the present invention wherein a driving circuit is constituted from a thin film transistor.

The present invention can also be applied to a thermal head wherein a driving circuit is constituted from a thin film transistor or transistors. In particular, referring to FIG. 5, the thermal head shown includes a heat generating resistor element 22A made of a polycrystal silicon thin film 22 formed on one flat face 21*a* of a substrate 21, and an active layer 22B of a thin film transistor constituting a driving circuit for the heat generating resistor element 22A and also made of the polycrystal silicon thin film 22. A heat radiating supporting plate 25 is joined to the heat generating resistor element 22A and the thin film transistor via an oxidation resisting layer 23 and an adhesive layer 24. An end portion of the substrate 21 near the heat generating resistor element 22A is cut obliquely to form an inclined face 26 by which thermal recording is to be performed. In this instance, a driving current which is supplied via an electrode 27 for external connection passes through a conductor layer 28*a*, drives the thin film transistor 23 of the MOS-FET structure including three layers of a gate electrode 29, an insulator film 30 and the polycrystal silicon thin film 22B, and causes the heat generating resistor element 22A to generate heat via a conductor layer 28*b*. If a driving circuit is constituted from a thin film transistor as in the present embodiment, wire bonding becomes unnecessary. Accordingly, further reduction in size of the head and improvement in reliability can be attained, and it is advantageous also in productivity and mass productivity.

EMBODIMENT 6

Figure 6:
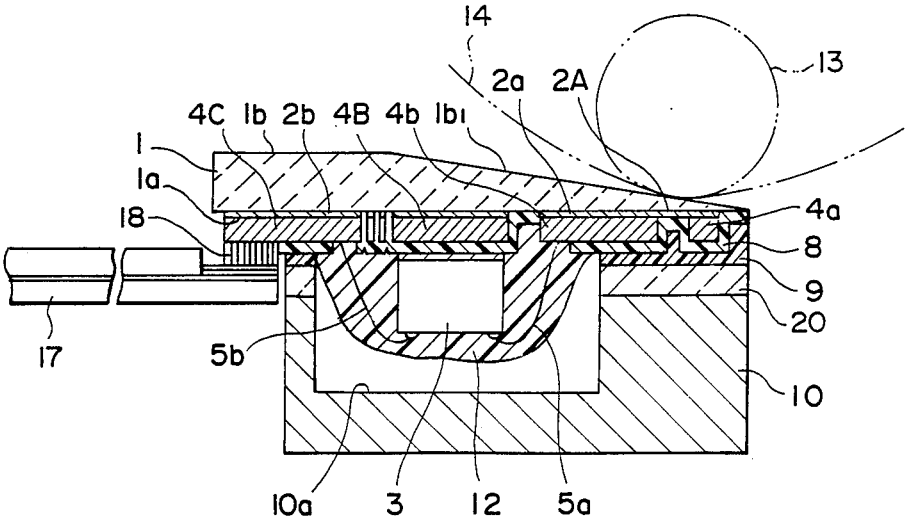
FIG. 6 is a schematic sectional view of a thermal head illustrating a sixth embodiment of the present invention wherein a transparent or translucent substrate is employed.
Figure 7:
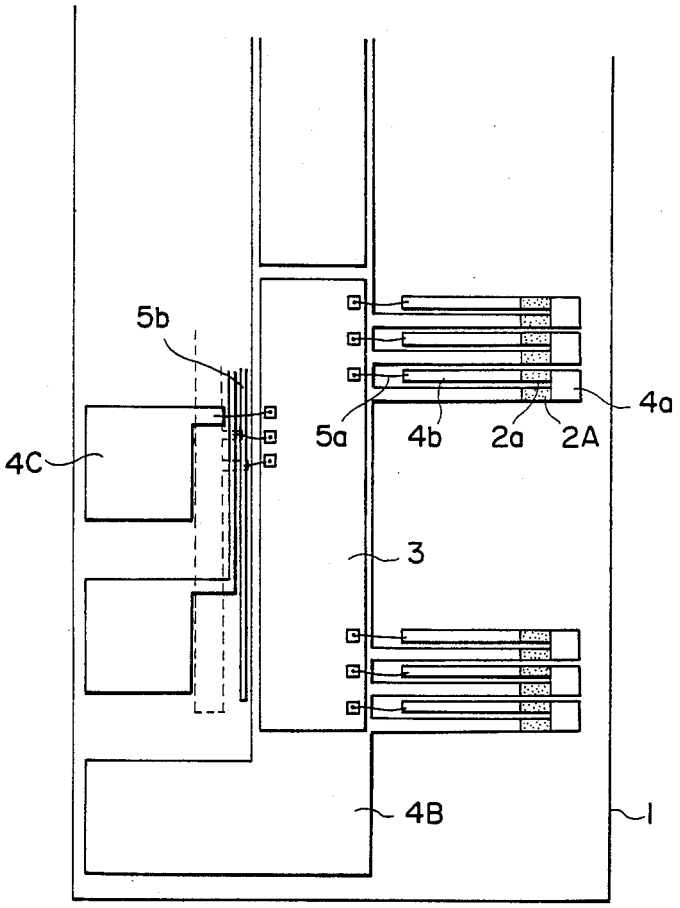
FIG. 7 is a plan view of the substrate of the thermal head of FIG. 6 as viewed from an inner face side.

Referring now to FIGS. 6 and 7, a thermal head is shown wherein a transparent or translucent wear resisting substrate is used as a substrate. In particular, the wear resisting substrate 1 of the thermal head may be made of quartz, glass which contains no alkali components therein or some other suitable transparent or translucent material. In the present embodiment, borosilicate glass is employed for the substrate 1.

A rear face 1*b* of the substrate 1 serves as a thermal recording face, and the substrate 1 is reduced in thickness at a portion thereof corresponding to a heat generating portion 2A of one of the heat generating resistor patterns or elements 2*a*, 2*b* such that an inclined face $1b_1$ may be formed on the rear face 1*b* side of the substrate 1 for slidably contacting with heat sensitive record paper 14 to press and hold the heat sensitive record paper 14 against and on a platen 13 in order to effect thermal recording on the heat sensitive record paper 14.

Meanwhile, a flexible printed circuit plate 17 for establishing electric communication with an external driver circuit is connected via an anisotropic conductor film 18 to a rear half portion of an electrode pattern or conductor layer 4*c* as an external terminal formed in a layer on a rear half portion of the other heat generating resistor pattern 2*b* on the substrate 1.

Since glass, quartz or some other suitable materials which are inexpensive comparing with a conventionally employed material such as a glazed ceramics material are used as a material of the substrate 1, significant reduction in material cost can be attained coupled with reduction in size.

Figure 8A:
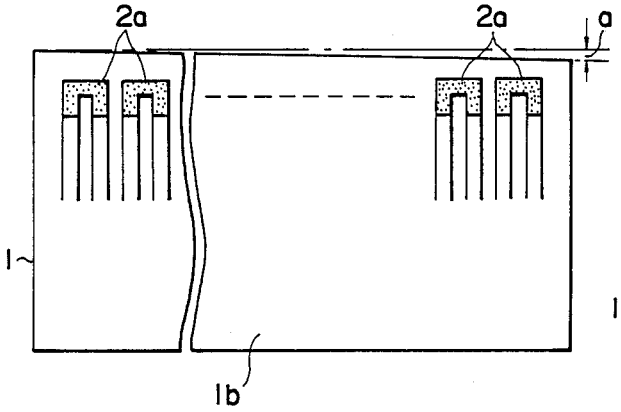
FIGS. 8A and 8B are a schematic plan view and a schematic side elevational view, respectively, of the substrate of FIG. 6 joined to a supporting heat radiating plate.
Figure 8B:
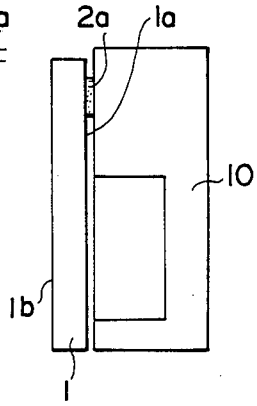

As described above, the substrate 1 is formed from a suitable transparent or translucent wear resisting material such as glass. Accordingly, in an operation to join and fix the substrate 1 to a supporting heat radiating plate 10, the heat generating resistor patterns 2*a*, 2*b* on one flat face 1*a* of the substrate 1 can be readily observed and recognized from the side of the rear face 1*b* of the substrate 1 which serves as a recording face. Accordingly, even if the substrate 1 has a difference a in dimension between opposite edges thereof as illustrated in FIG. 8A caused by an error of cutting, positioning of the heat generating resistor patterns 2*a*, 2*b* relative to the supporting heat radiating plate 10 can be effected with accuracy as seen from FIG. 8B. Besides, a bonding agent of the type which is hardened by an ultraviolet ray can be used for an adhesive layer 9 for adhering the substrate 1 and the supporting heat radiating plate 10 to each other, and if the bonding agent of the specific type is employed, the substrate 1 and the supporting heat radiating plate 10 can be adhered to each other without having a bad influence of heating on the substrate 1 and so on, which will allow the substrate 1 and the supporting heat radiating plate 10 to be joined to each other more assuredly.

Here, the supporting heat radiating plate 10 may be made of a ceramics material such as $Al_2O_3$, an alloy of a Fe-Ni family, a metal material such as Fe or Al which is high in heat transmission, and so on. For adhesion of the supporting heat radiating plate 10, a layer 20 of glass having a low melting point and a suitable heat transfer rate is formed on a face of the supporting heat radiating plate 10 opposing to the substrate 1. Thus, the glass layer 20 has, in addition to an adhering function, a function as a conventional glazed layer.

After fixation of the substrate 1 and the supporting heat radiating plate 10 to each other in this manner, the rear face 1*b* of the substrate 1 is partially ground obliquely until a portion of the substrate 1 above the heat generating portion 2A has a predetermined thickness in order to form a recording face $1b_1$ on the substrate 1.

Figure 9:
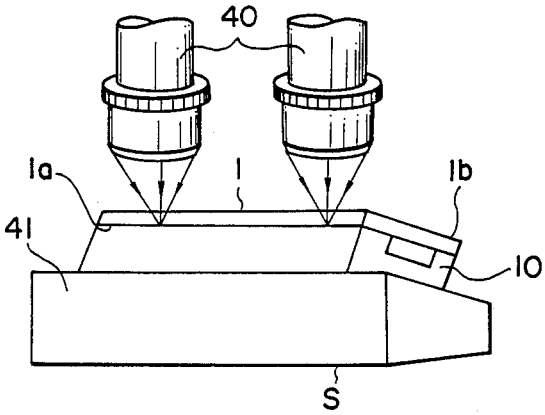
FIG. 9 is an illustration showing a manner of grinding of the substrate of FIG. 6.

When the substrate 1 is to be ground, the heat generating resistor patterns 2*a*, 2*b* are optically observed through the substrate 1 from the rear face 1*b* side of the substrate 1 using a microscope monitor 40 as shown in FIG. 9, and the microscope monitor 40 is adjusted to a point at which the patterns 2*a*, 2*b* make a clear image. Then, with reference to this, a working reference plate S of a working platform 41 is adjusted, and in this condition, the substrate 1 is ground to a predetermined thickness by a vertical or horizontal surface grinding mechanism to form the recording face $1b_1$. The recording face $1b_1$ is a face which is inclined at a predetermined angle as described hereinabove, and the angle of inclination is preferably within a range from 5 to 45 degrees: the angle of inclination smaller than 5 degrees would make the material of a portion of the substrate 1 at the recording face $1b_1$ too weak, and the angle of inclination greater than 45 degrees would make the material of the portion of the substrate 1 too thick to obtain a good quality of printing.

Meanwhile, the overall magnification of the aforementioned microscope monitor 40 is determined in accordance with a required accuracy. For practical use, a magnification of 400 times may be employed. It is to be noted that the thickness of a glass material for a substrate is normally 5 to 100 microns, and a sufficient glass strength cannot be assured where the thickness is less than 5 microns, but to the contrary where the thickness is more than 100 microns, blurring will readily appear in printing and make printing unclear. Further, the surface roughness should be 0.1 to 3 μmRa, and the surface roughness of 1 μmRa can be obtained by a #400 grind stone and is satisfactory in practical use.

In this manner, according to the present embodiment, since reduction in size of the substrate, that is, reduction in area of the contacting face of the platen, can be allowed, a so-called vertical type thermal head can be attained. Accordingly, a color printer or a like device of the 1-platen multi-head type of a small size can be produced at a low cost.

EMBODIMENT 7

Figure 10:
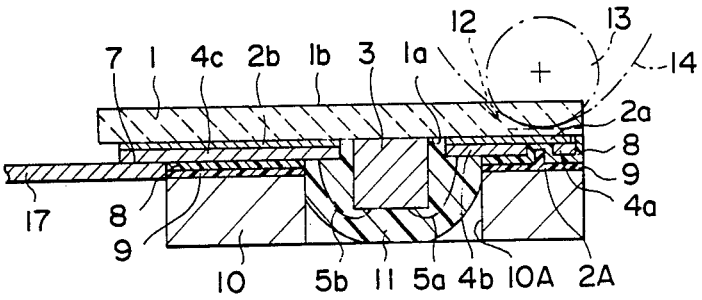
FIG. 10 is a schematic sectional view of a thermal head illustrating a seventh embodiment of the present invention wherein a supporting heat radiating plate having a through-hole formed therein is employed.
Figure 11:
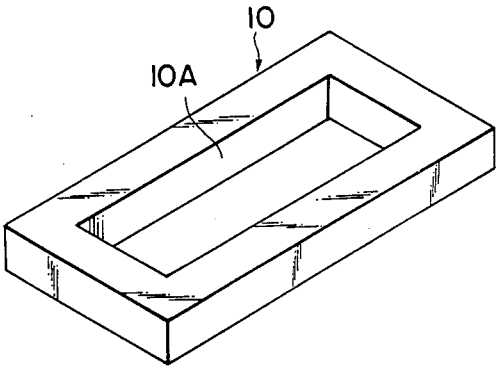
FIG. 11 is a perspective view of an example of supporting heat radiating plate having a through-hole formed therein.

Referring now to FIGS. 10 and 11, a thermal head is shown which employs a supporting heat radiating of a specific configuration. In particular, the thermal head shown includes a supporting heat radiating plate 10 which has a profile of a substantially rectangular parallelepiped having a substantially rectangular through-hole 10A formed therein so that a semiconductor element or driving integrated circuit device 3 may be accommodated therein and encapsulating agent 11 for enclosing the semiconductor element or driving integrated circuit device 3 may be poured therein.

Figure 12:
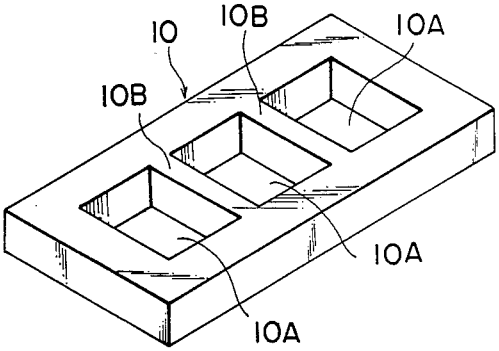
FIG. 12 is a similar view but showing another example of supporting heat radiating plate having a through-hole formed therein.
Figure 13:
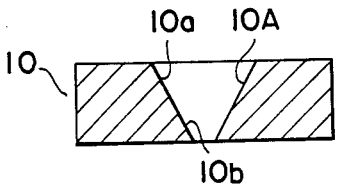
FIG. 13 is a schematic sectional view showing a further example of supporting heat radiating plate having a through-hole formed therein.
Figure 14:
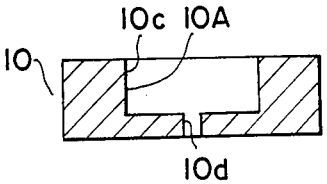
FIG. 14 is a similar view but showing a still further example of supporting heat radiating plate having a through-hole formed therein.

The supporting heat radiating plate 10 may have, apart from the specific configuration described just above, any other configuration only if it has formed therein a hole which can accommodate the driving integrated circuit device 3 therein and in which resin material for enclosing the driving integrated circuit device 3 can be poured. For example, the supporting heat radiating plate 10 may have a configuration as shown in FIG. 12 wherein it has a plurality of substantially square through-holes 10A formed therein for accommodating individual driving integrated circuit devices 3 therein and partitioned by a partition 10B from each other. Or otherwise, as shown in FIG. 13, a through-hole 10A may have a trapezoidal cross section which has a greater width at an opening through which a driving integrated circuit device is put into the through-hole 10A and a smaller width at the opposite opening through which encapsulating agent is poured into the through-hole 10A. Or else, as shown in FIG. 14, a through-hole 10A may consist of an accommodating portion **10*c* for accommodating a driving integrated circuit device therein and a narrow pouring portion 10*d*** for pouring encapsulating agent therethrough.

By forming the supporting heat radiating plate 10 in any of such configurations as described above, a process of producing a thermal head can be improved. For example, referring back to FIG. 10, the supporting heat radiating plate 10 can be adhered before the driving integrated circuit device 3 and a flexible printed circuit plate 17 are formed on the substrate 1 on which heat generating resistor elements or patterns **2*a*, 2*b* and conductor layers or electrode patterns 4*a*, 4*b*, 4*c* are formed. Accordingly, high temperature adhesion using a bonding agent which is superior in heat resisting performance becomes possible, which will assure adhesion of the supporting heat radiating plate 10. Further, since encapsulating agent 11 for enclosing the driving integrated circuit device 3 can be poured through the encapsulating agent pouring hole after the driving integrated circuit device 3 has been mounted on the substrate 1 after mounting of the supporting heat radiating plate 10, such pouring of the encapsulating agent 11** can be performed readily and assuredly, which will result in improvement in production efficiency and also in available percentage.

A process of producing a thermal head which employs such a supporting heat radiating plate 10 that has any of the configurations described above will be described below.

Figure 15A:
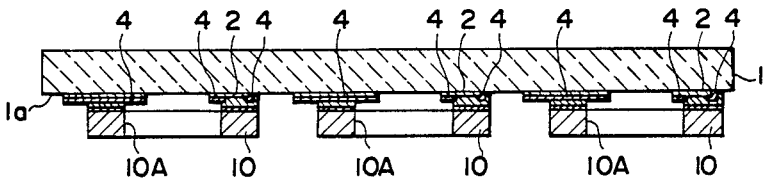
FIGS. 15A to 15F are schematic sectional views illustrating different steps of a process of producing a thermal head wherein a supporting heat radiating plate having a through-hole formed therein is employed, and FIG. 15A illustrating a step of adhering a heat radiating plate, FIG. 15B a step of adhering a driving integrated circuit device and bonding a wire, FIG. 15C a step of packaging the driving integrated circuit device, FIG. 15D a step of cutting a set substrate, FIG. 15E a step of grinding a rear face of a substrate, and FIG. 15F a step of adhering a flexible printed circuit plate.

At first, a plurality of sets of heat generating resistor elements 2 and conductor layers 4 are formed on a set substrate 1 using a normal thermal head forming technique. After that, supporting heat radiating plates 10 each having formed therein a through-hole 10A in which a driving integrated circuit device 3 to be mounted at a subsequent next step is to be accommodated and into which encapsulating agent for enclosing the driving integrated circuit device 3 is to be poured are adhered to a main face **1*a* of the set substrate 1 as shown in FIG. 15A using a bonding agent. The bonding agent used then may have a high heat resisting performance. This is because the supporting heat radiating plates 10 can be mounted before driving integrated circuit devices 3 which do not have a very high heat resisting performance are mounted on the set substrate 1 and accordingly there is no restriction to an adhering temperature when the supporting heat radiating plates 10 are mounted. Due to such high temperature processing, the reliability in adhesion of the supporting heat radiating plates 10** can be improved.

Figure 15B:
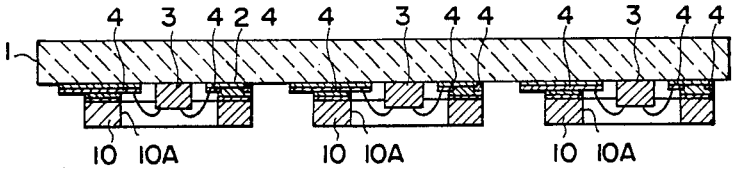

Subsequently, driving integrated circuit devices 3 are mounted in the through-holes 10A of the supporting heat radiating plates 10 and are connected to the conductor layers 4 on the set substrate 1 by wire bonding as shown in FIG. 15B.

Figure 15C:
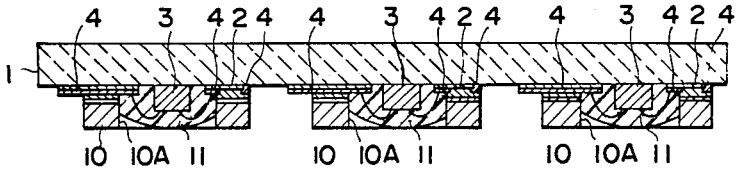

After that, encapsulating agent 11 for enclosing the driving integrated circuit devices 3 mounted in such a manner as described above is poured into the through-holes 10A of the supporting heat radiating plates 10 through openings of the through-holes 10A remote from portions of the set substrate 1 on which the driving integrated circuit devices 3 are mounted in order to package the driving integrated circuit devices 3 as shown in FIG. 15C. The encapsulating agent 11 used then has functions as a bonding agent and also as a protective agent for the driving integrated circuit devices 3, and preferably an encapsulating agent having a heat resisting performance and a high heat transfer rate is used for the encapsulating agent 11. Thus, a photosetting resin material or a thermosetting resin material may be used for the encapsulating agent 11.

Figure 15D:
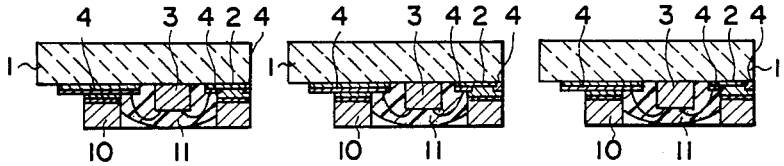

Subsequently, the set substrate 1 is cut into individual thermal heads as shown in FIG. 15D.

Figure 15E:
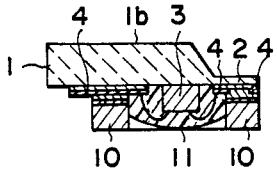

After then, the rear face **1*b* of each of the substrates 1 is ground as shown in FIG. 15E** in order to improve the contacting characteristic thereof with a platen, and the thermal head is inspected for its function as a thermal head.

Figure 15F:
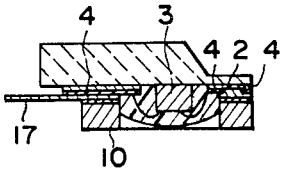

Finally, a flexible printed circuit plate 17 for establishing external connection is pressed against and attached to the substrate 1 as shown in FIG. 15F to complete the thermal head.

It is to be noted that, in the production process described above, the step of cutting the set substrate 1 into individual thermal heads and the inspection step may be reversed in order.

EMBODIMENT 8

Figure 16:
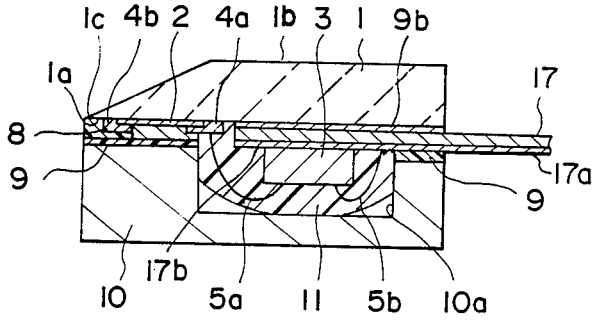
FIG. 16 is a schematic sectional view of a thermal head illustrating an eighth embodiment of the present invention wherein a flexible base plate is applied to a substrate and an integrated circuit device is mounted on the flexible base plate.
Figure 17:
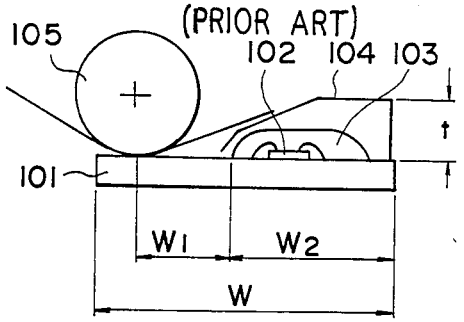
FIG. 17 (PRIOR ART)
FIG. 17 is a diagrammatic side elevational view showing a conventional thermal head.

Referring now to FIG. 16, a thermal head is shown wherein a printed circuit board in the form of a flexible circuit board is used as a conductor layer or wiring circuit. The thermal head shown includes a heat generating resistor element or pattern 2 formed at a location on one main face 1*a* of a substrate 1 adjacent a side edge portion 1*c* of the substrate 1, and a flexible base plate or printed circuit plate 17 mounted on the one main face 1*a* of the substrate 1 by way of a bonding agent layer 9*b* and having a driving integrated circuit device 3 mounted at a location thereon adjacent the heat generating resistor element 2. A supporting heat radiating plate 10 is integrally joined via an oxidation resisting layer 8 and an adhesive layer 9 to the heat generating resistor element 2 and the flexible base plate 17 on which the driving integrated circuit device 3 is mounted. A portion of a rear face 1*b* of the substrate 1 corresponding to a location at which the heat generating resistor element 2 is formed is ground obliquely to form a ground face by which thermal recording is to be effected.

A semiconductor element having a predetermined performance is used as the driving integrated circuit device 3, and by mounting the driving integrated circuit device 3 on the flexible base plate 17, it is mounted at a location adjacent a side edge 17*b* of the flexible base plate 17. Further, the flexible base plate 17 mounting the driving integrated circuit device 3 is securely adhered to the substrate 1 by the bonding agent 9*b*.

The flexible base plate 17 has a wiring circuit 17*a* for transmission of an external signal formed on one main face thereof on which the driving integrated circuit device 3 is mounted, and the wiring circuit 17*a* is connected to the driving integrated circuit device 3 mounted on the flexible base plate 17 by means of a gold wire 5*b*. It is to be noted that the wiring circuit 17*a* formed on the flexible base plate 17 may be formed not only on the one main face of the flexible base plate 17 but also on the other face of the flexible base plate 17, and accordingly the wiring circuit 17*a* may be formed on each of opposite faces of the flexible base plate 17.

In the thermal head of the embodiment described above, the substrate 1 must only have a minimum space required for adhesion of the heat radiating base member 10 thereto. Accordingly, a space for mounting of a driving integrated circuit device and a space for adhesion of a flexible base plate which have been required separately in a conventional thermal head can be replaced by a single space in which a driving integrated circuit device is mounted, which makes it unnecessary to provide a substrate with an exclusive space for adhesion of a flexible base plate. Accordingly, the restriction in dimension of the substrate 1 is moderated significantly and reduction in size of the thermal head can be attained.

Further, since the wiring circuit 17*a* is located on the flexible base plate 17 and is directly connected to the driving integrated circuit device via the gold wire 5*b*, a wiring circuit which has been conventionally formed on a substrate, an anisotropic conductor film for connection of the wiring circuit, and some other elements can be omitted. Accordingly, a transmission route of an external signal can be simplified and the reliability in transmission of a signal and in connecting points can be improved.

It is to be noted that while in the last embodiment the flexible base plate 17 is employed in the thermal head, it may otherwise be replaced by a rigid base plate.

Having now fully described the invention, it will be apparent to one of ordinary skill in the art that many changes and modifications can be made thereto without departing from the spirit and scope of the invention as set forth herein.

What is claimed is:

1. A thermal head for recording on a recording medium comprising;

a substrate having a thick portion and a thin portion, said thin portion having a first flat surface and a second surface formed on an opposite side of said substrate from said first flat surface, said second surface being adapted to contact said recording medium, a plurality of heat resistor elements formed on said first flat surface of said thin portion of said substrate, wiring circuit means for said heat resistor elements formed on said first flat surface of said substrate and driving means for driving said heat resistor elements formed by said first flat surface of said substrate, said thin portion being made by grinding said second surface of said substrate.

2. A thermal head according to claim 1, wherein said ground portion of said substrate is located adjacent an edge or end of said substrate.

3. A thermal head according to claim 2, wherein said ground portion of said substrate presents an inclined face formed by obliquely grinding the opposite face of an edge or end portion of said substrate.

4. A thermal head according to claim 3, wherein said inclined face is inclined at an angle from 5 to 45 degrees.

5. A thermal head according to claim 1, wherein said ground portion of said substrate presents a surface substantially parallel to the opposite face of said substrate.

6. A thermal head according to claim 1, wherein said substrate is ground over an entire face thereof opposite to said one face such that said substrate may have a predetermined thickness over the entire area thereof.

7. A thermal head according to claim 1, wherein said supporting heat radiating member has a recess formed at a central portion thereof, and said driving circuit means is accommodated in said recess.

8. A thermal head according to claim 7, wherein said driving circuit means accommodated in said recess is located on said heat generating resistor element on said substrate via a conductor layer and an oxidation resisting layer.

9. A thermal head according to claim 8, wherein said ground portion of said substrate is formed at an intermediate location of said substrate and presents a surface substantially parallel to the opposite face of said substrate.

10. A thermal head according to claim 7, wherein said driving circuit means accommodated in said recess is enclosed in an encapsulating agent together with wiring means for interconnecting said heat generating resistor element and said driving circuit means.

11. A thermal head according to claim 7, further comprising a conductor layer formed on said one face of said substrate, means for electrically connecting said driving circuit means to said conductor layer, and a connecting pin for external connection connected to said conductor layer and extending through and outwardly from said supporting heat radiating member.

12. A thermal head according to claim 7, further comprising a conductor layer formed on said one face of said substrate, means for electrically connecting said driving circuit means to said conductor layer, and a lead conductor for external connection connected to said conductor layer and extending along a side face of said supporting heat radiating member.

13. A thermal head according to claim 7, further comprising a conductor layer formed on said one face of said substrate, means for electrically connecting said driving circuit means to said conductor layer, and a flexible printed circuit plate for external connection connected to said conductor layer.

14. A thermal head according to claim 13, wherein said flexible printed circuit plate is connected to said conductor layer via an anisotropic film on said conductor layer.

15. A thermal head according to claim 1, wherein said driving circuit means includes a thin film transistor formed on said substrate.

16. A thermal head according to claim 1, wherein said substrate is formed from a transparent or translucent wear resisting material.

17. A thermal head according to claim 16, wherein the transparent or translucent wear resisting material of said substrate is either quartz or glass which contains no alkali component therein.

18. A thermal head according to claim 16, wherein the transparent or translucent wear resisting material of said substrate is boro-silicate glass, and said substrate has a thickness of 5 to 100 microns.

19. A thermal head according to claim 1, wherein said supporting heat radiating member has a through-hole formed to extend in a direction of the thickness therein and is mounted on said substrate such that said driving circuit means may be accommodated in said through-hole.

20. A thermal head according to claim 1, comprising wiring circuit means for interconnecting said heat generating resistor element and said driving circuit means, and said supporting heat radiating member having a through-hole formed to extend in a direction of the thickness therein and mounted on said substrate such that said driving circuit means may be accommodated in said through-hole.

21. A thermal head according to claim 20, wherein said supporting heat radiating member has a plurality of through-holes each formed to extend in a direction of the thickness therein for accommodating said driving circuit means therein.

22. A thermal head according to claim 1, comprising a flexible base plate located on said substrate for transmitting an external signal to said driving circuit means, wiring circuit means for electrically interconnecting said heat generating resistor element, said driving circuit means and said flexible base plate, and a wiring circuit having an external lead circuit, and being formed on one of opposite faces of said flexible base plate on which said driving circuit means is mounted, said flexible base plate being connected at the other face thereof in a closely contacting relationship to said substrate.

* * * * *